114-253 SR
12/1/81 XR 4,302,858

United States Patent [19]

Casciano

[11] 4,302,858

[45] Dec. 1, 1981

[54] STEERABLE TOWED VEHICLE

[76] Inventor: Frederick M. Casciano, 1651 Ala Moana Blvd., Honolulu, Hi. 96815

[21] Appl. No.: 930,093

[22] Filed: Aug. 1, 1978

[51] Int. Cl.[3] ..... A63C 5/00; B63B 21/56

[52] U.S. Cl. ..... 9/310 B; 114/253; 440/34

[58] Field of Search ..... 114/204, 205, 112, 242, 114/253, 246, 144 R, 144 A, 285; 9/6 P, 310 B, 310 C, 310 E; 115/6.1; 440/33, 34

[56] References Cited

U.S. PATENT DOCUMENTS

| | | | |
|---|---|---|---|
| 156,039 | 10/1874 | Poole | 114/205 |
| 2,576,744 | 11/1951 | Anderson | 114/285 |
| 2,758,321 | 8/1956 | Westfall | 9/6 P |
| 3,117,547 | 1/1964 | Cohen et al. | 114/285 |
| 3,216,031 | 11/1965 | Ingold | 9/310 B |
| 3,237,222 | 3/1966 | Frost | 9/310 B |
| 3,604,031 | 9/1971 | Cahill | 9/310 C |
| 3,623,445 | 11/1971 | Holmes | 114/204 |
| 3,628,486 | 12/1971 | Bennett | 114/285 |
| 3,824,945 | 7/1974 | Casciano | 114/246 |
| 3,952,354 | 4/1976 | Turner | 9/310 B |
| 4,080,919 | 3/1978 | Holland et al. | 114/204 |
| 4,129,911 | 12/1978 | McDonald et al. | 9/6 P |

FOREIGN PATENT DOCUMENTS

| | | | |
|---|---|---|---|
| 611838 | 10/1926 | France | 114/112 |

*Primary Examiner*—Charles E. Frankfort
*Attorney, Agent, or Firm*—James C. Wray

[57] ABSTRACT

A watersled towed behind a moving boat is steerable from side to side by a rider pulling on or releasing the handle on a single control rope which is attached to a tow rope. The handle is held at various positions by two cleats connected to a raised section of the top deck of the sled between the rider's legs to facilitate proper operation of the sled. The tow rope is attached to the rear of the sled by being passed through an opening in the hull and knotted. The tow rope is held in proximity to the bottom of the sled by passing the rope through a plastic slide configured to travel within a groove extending the width of the sled. The groove is shaped in an arc having a center at the tow rope attachment point and has end closures to prevent the slide from leaving the groove. The control rope is held forward of the tow rope attachment point by a knot in the tow rope. Asymetrical trim tabs are attached to the stern by hinges and are adjustable to vary the amount of lift astern to account for different rider weights. The sled is fabricated with spongy foam exterior surfaces on rigid stringers to reduce injuries to the rider.

16 Claims, 11 Drawing Figures

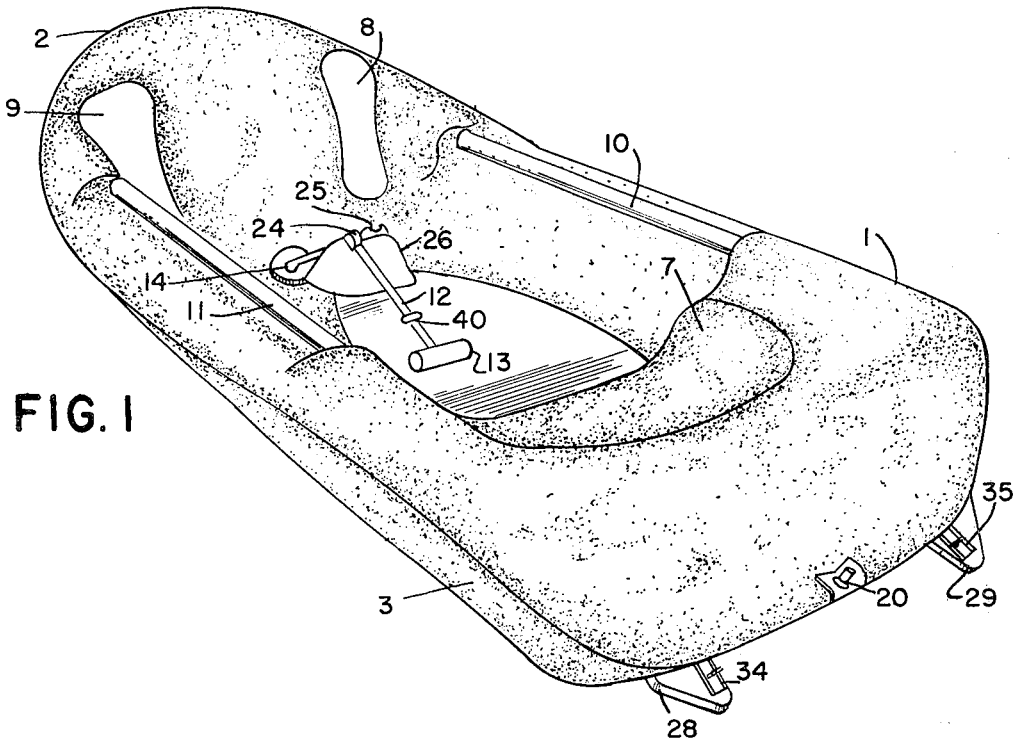
FIG. 1
FIG. 2
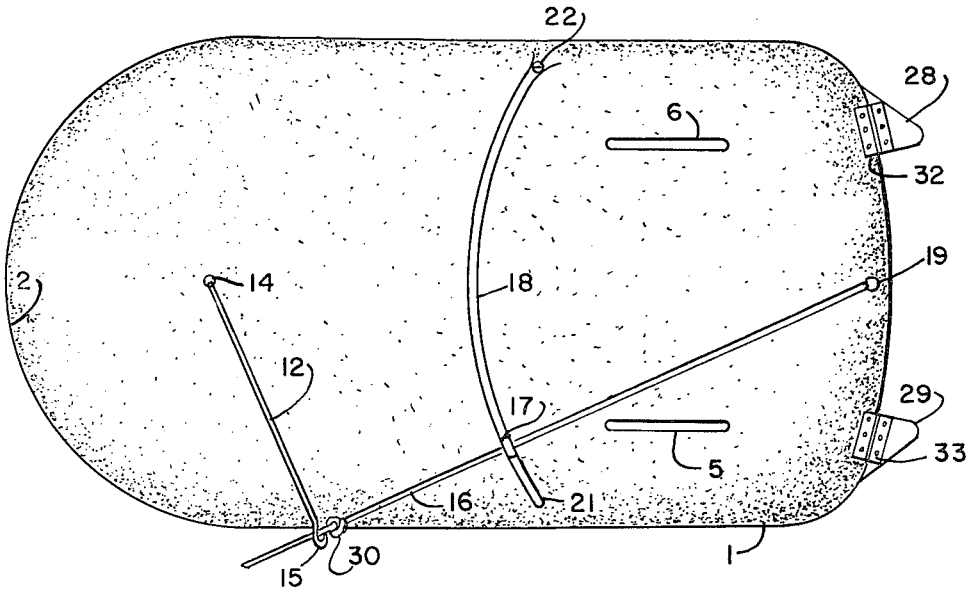

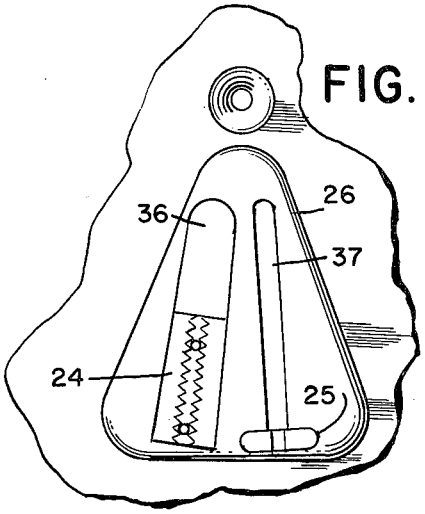
FIG. 4
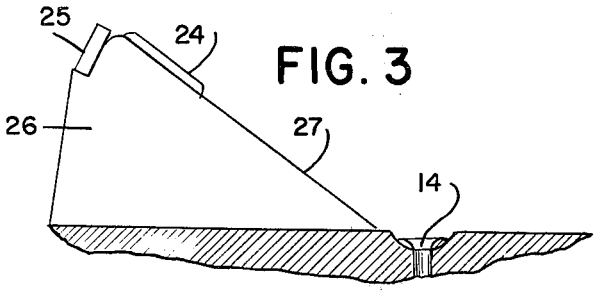
FIG. 3
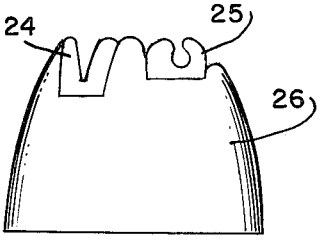
FIG. 5
FIG. 11
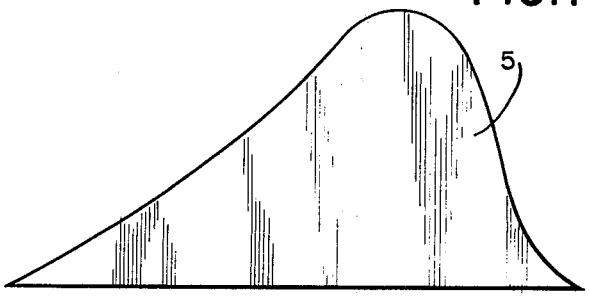
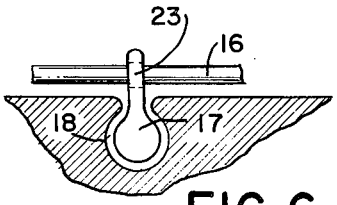
FIG. 6
FIG. 7
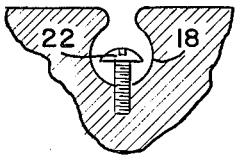
FIG. 8
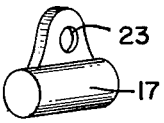
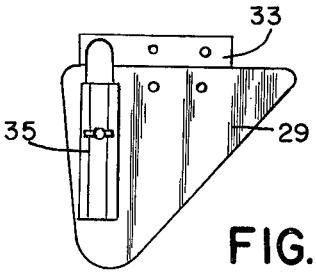
FIG. 9
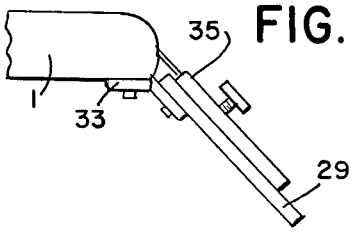
FIG. 10

STEERABLE TOWED VEHICLE

BACKGROUND OF THE INVENTION

1. Field of the Invention

This invention relates generally to water vehicles and more particularly has reference to towed water sleds having steering mechanisms.

2. Description of the Prior Art

The water sled is used in a fashion similar to water skis and aquaplanes, i.e., while being towed behind a speedboat. It has the maneuverability of water skis with the advantage of freeing the rider from the strain of holding the tow rope and the other physical demands required to maneuver on skis. The aquaplane, which has the towline attached, makes minimal physical demands upon the rider yet is virtually unsteerable. Modifications to the aquaplane design have yet to produce effective steering control. Still other designs appear to allow relative position control with respect to the tow boat yet do not cause the bow of the sled to point in the direction of relative movement.

The present invention is an improvement upon a towed vehicle such as a watersled which is intended for use in the field of water sports and recreation. The invention improves upon the watersled previously disclosed by Casciano in U.S. Pat. No. 3,824,945.

The sled to which this invention applies is towed behind a powered vehicle such as a motorboat in a manner similar to water skis. A seated rider can steer the sled back and forth across the boat wake by pulling on or releasing a control rope which passes through an opening in the front of the sled and attaches to the tow rope. The tow rope is in turn attached to the stern of the sled.

The prior sled design does not provide a cleat vitally needed for intermediate extension of the control rope when performing sharp maneuvers from one side of the boat to the other known as cutbacks. In the previous Casciano patent, the cleat is placed on the deck between the rider's legs, near his body, making it very difficult for the rider to hold the strain of the control rope and effect cleating.

The prior sled provides a means for holding the tow rope close to the hull which causes drag and vibration and performs ineffectively. In addition, excessive drag is caused by the ring to which the tow rope is attached at the stern.

The prior sled does not provide means for adjusting the trim of the sled for riders of varying weights. Also, the construction process described in the earlier patent, using a rigid material such as fiberglass for the hull, can cause minor bumps and bruises to the rider.

The previous design has no means for preventing the control rope from sliding further along on the tow rope to the rear than is desired for optimum stability when the sled is out to one side of the boat. The present invention prevents abrupt reversal of the towed vehicle by preventing excessive rearward movement of the control rope-tow rope connection.

SUMMARY OF THE INVENTION

The present invention overcomes many of the problems which exist in the prior art devices.

The present invention provides cleats in a raised and accessible location on the sled. A cleat designed for use during cutback maneuvers is also provided.

The present invention further provides improved means for holding the tow rope close to the hull and improved means for eliminating drag and vibration during use.

The present invention still further provides trim tabs and provides a sled constructed of supple material.

The present invention yet further prevents abrupt reversal of the sled by preventing excessive rearward movement of the control rope-tow rope connection.

In preferred form, the present invention utilizes two cleats which hold the control rope at various positions of extension. The cleats are located on a raised mounting forward of the rider's body to reduce chance of injury and improve accessibility. One cleat is a clam cleat which selectively holds the rope at various positions. The second cleat is mounted adjacent and preferably alongside the first cleat and is configured to hold the rope in an intermediate position. The second cleat is especially useful when performing abrupt cutback maneuvers from one side of the boat to the other. The second cleat permits the proper amount of extension of the control rope during cutback so that the sled strikes the wake at the correct angle, possible tipping of the sled is avoided and excessively rapid and violent action of the sled is prevented.

The cleats are mounted so that the control rope is readily seated without undue strain on the rider. Since adjustments in control rope length are made hurridly during operation to achieve good performance, such placement and alignment of the cleats is of importance.

The present invention also improves upon the apparatus used to hold the tow rope in close proximity to the bottom of the sled to prevent tipping of the sled. An internal groove or track extends in an arc across the width of the sled and receives a slide. The tow rope passes through a hole in the slide and is thus held near the bottom of the sled as it sweeps from side to side during maneuvers. This configuration eliminates hydrodynamic drag and vibration and performs more effectively than the prior method.

Flat plates or trim tabs attached to the stern by hinges, are adjustable to vary trim of the sled for riders of different weights. The plates are shaped asymmetrically to avoid interference with the hydrodynamics of the steering system. An alternate method of avoiding adverse hydrodynamic effects could be accomplished by attaching the trim tabs to the tips of the skegs which are at the pivot point of the sled or one trim plate could be attached between the skegs.

The tow rope is attached to the hull at the stern by passing the rope through an opening in the sled and knotting the rope above the sled. This arrangement reduces drag which is encountered by a fixture such as a ring or eyelet attached to the bottom of the sled to secure the tow rope.

Apparatus for preventing the joint means connecting the control rope and tow rope from sliding too far to the rear when the control rope is fully extended is provided in the form of a knot or other stopper means placed on the tow rope. Without such stopper, the control rope has a tendency to slide rearwardly on the tow rope as strain on that rope momentarily increases. This is undesirable from equilibrium considerations. In addition, a knot is provided in the control rope between the handle and the cleat to facilitate grasping the handle.

In one fabrication process, the sled has a soft spongy foam exterior which provides cushioning for the rider and minimizes the chance of bruises and injuries to his body. A rigid backbone or stringer is set internally to provide strength and is shaped to receive all fixtures which are rigidly connected to the sled.

One object of the invention is to provide an improved steerable water sled which is easier to operate, performs more satisfactorily, and provides a more pleasant and safe ride.

Another object is to provide a towed water sled vehicle comprising, a body having a passenger compartment with a raised portion positioned on the centerline of the body, a first rope attachment mounted on the body near a stern thereof, a second rope attachment mounted on the body forward of the first attachment, a first rope connected to the first attachment, a second rope connected to the second attachment, joint means for joining the ropes remote from the attachments and means for towing the vehicle from the joint means, and holding means connected to the vehicle for holding the first rope close to the vehicle thereby preventing tipping of the vehicle, the holding means comprising a groove formed in the body and positioned between the first and second rope attachments, a slide mounted in the groove and having a portion extending from the body with an opening, the first rope passing through the opening, the second attachment comprising an opening in the body and wherein the second rope passes through the opening, and further comprising a handle connected to one end of the second rope, and a cleat connected to the raised portion for holding the handle a distance from the opening, wherein the joint means comprises a member having a portion attached to the second rope remote from the second attachment and a portion having an opening, and wherein the first rope and means for towing comprises a single tow rope threaded through the opening and having a terminus attached to the first attachment, the tow rope provided with a radial projection positioned between the first attachment and the opening for limiting movement of the member to positions remote from the first attachment, adjustable connecting means connected to a stern of the body for supporting tabs in selected orientation with respect to the body, tabs connected to the adjustable connecting means for controlling the trim of the towed water vehicle, and wherein the body comprises relatively rigid internal stringers and relatively supple external coatings formed on the stringers, the stringers configured to receive the first and second rope attachments, the holding means, the cleat and the adjustable connecting means. The stringers could be in the form of a single flat plate located external to the supple coating and below it forming the bottom of the sled. The supple coating could be formed from flexible plastic foam or an inflatable material.

These and other and further objects and features of the invention are apparent in the disclosure which includes the above and below specification and claims and drawings.

BRIEF DESCRIPTION OF THE DRAWING

FIG. 1 is a top perspective view of the vehicle showing the general shape of the hull, the cleats mounted on the raised section, the trim tabs, and the tow rope attachment.

FIG. 2 is a bottom plan view of the sled showing the groove and slide with the control rope in the fully extended position.

FIG. 3 is a side detail view in elevation showing the raised section of the hull with the two cleats mounted.

FIG. 4 is a detail top plan view of the raised section of the hull showing the cleats and clearance grooves.

FIG. 5 is a detail front view in elevation of the raised cleat section.

FIG. 6 is a detail view in section, showing the groove and slide.

FIG. 7 is a detail view in section, showing the removable closure at one end of the groove.

FIG. 8 is a detail perspective view of the slide.

FIG. 9 is a top plan view of the right trim tab with hinge and locking mechanism.

FIG. 10 is a side view, in elevation, of the trim tab in FIG. 9.

FIG. 11 is an inverted right side view, in elevation, of the right skeg.

DETAILED DESCRIPTION OF THE DRAWINGS

Referring to FIGS. 1 and 2, the preferred form of the invention, as illustrated, shows the water sled having a boat-type hull 1 with a planing-type underbody which has a relatively flat bottom near the stern to provide vertical lift. Forward portions 2 and sides 3 are curved upward and outward. The curved portions enable the sled to skim the water surface without digging in or burying itself in small waves. Skegs or fins 5 and 6 are attached to the underbody near the stern to aid in turning. The right skeg 5 is shown in elevation in FIG. 11. The rider sits on the seat 7 and places his feet on the footpads 8 and 9 and holds on to handrails 10 and 11.

The specific operation and steering of the sled are described in detail in U.S. Pat. No. 3,824,945. Generally, steering is accomplished by the rider's pulling on or releasing a handle 13 attached to one end of a control rope 12. The control rope 12 passes through an opening 14 in the forward central portion of the top deck and emerges below the hull 1 where it is secured to a tow rope 16 by a loose knot or eyelet 15. The tow rope 16 passes through a hole 23 in a slide 17 positioned in an internal groove, or track, 18. The groove 18 and slide 17 are shown in detail in FIGS. 6 and 8, respectively. The tow rope 16 passes through opening 19 in the rear of the sled 1 and is knotted 20 to prevent the end of the rope 16 from being pulled through the opening 19. This particular means for attaching the tow rope 16 to the hull 1 produces a minimum of drag.

The groove 18 extends in an arc from one side of the hull 1 to the other on a radius equal to the distance from the rear opening 19. The groove 18 is located aft of opening 14 along the centerline of the hull 1. Arcing the groove 18 results in minimum binding effects on the slide 17 during side to side movement of the tow rope 16. The slide 17 and groove 18 arrangement holds the tow rope 16 close to the bottom of the hull 1. The arrangement is particularly effective in keeping the sled 1 from tipping when the control rope 12 is completely extended. The arrangement further results in a mechanism which is substantially above the bottom hull fairing and removed from the direct path of water flow thereby reducing drag and vibration.

The groove 18 is closed off at each end to prevent the slide 17 from falling out of the groove 18. At one end of the groove 18 the closure 21 is permanent. At the opposite end, the groove 18 is blocked by a screw 22 or other means that is removable for replacing the slide 17 when necessary. The slide 17 is made of plastic 18 or other suitable material designed to fail at a specified load and thereby prevent the groove 18 from being damaged during unusually violent motions of the sled 1. The groove 18 can be formed integrally with the hull or can be made separately by extrusion, for example, and attached to a channel in the hull with screws or rivets.

The sled 1 is steered by changing the length of control rope 12 extending below the sled 1, thereby changing the effective point of attachment of the tow rope 16 to the sled. When the control rope 12 is pulled fully inward the joint 15 between the ropes 12 and 16 is held snugly against the opening 14 in the hull 1, effectively causing the tow rope 16 to be attached to this point on the hull. With this arrangement, the sled 1 will tow directly in the path of the towboat. When the control handle 12 is released, the control rope 12 runs out freely through opening 14. Drag forces on the hull 1 cause the sled to rotate about point 19 as the control rope 12 pays out. When a knot 40 in the control rope 12 reaches opening 14, it is prevented from passing through the opening 14. Towing strain is taken by the bridle-like configuration shown in FIG. 2. The resulting water flow impinging on the skegs 5 and 6 forces the sled to the outside of the towboat wake.

Cleats 24 and 25 are provided for holding the control rope 12 at various positions. The cleats 24 and 25 are shown in detail in FIGS. 3, 4 and 5. A raised section 26 is provided in the hull 1 for mounting the cleats 24 and 25 above the deck for convenient and rapid adjustments of control rope 12. The raised section 26 is located forward of the rider's body and aligned between the rider's legs. The forward face 27 of the section 26 is inclined at an angle to the deck such that the cleats 24 and 25 are mounted with their principle axes along the direction of pull from the opening 14 to the rider's chest and shoulders. In this way, the rider can easily seat the rope 12 in either cleat while retaining tension on the rope 12 in a convenient and comfortable fashion. Grooves 36 and 37 located forward of the cleats 24 and 25 enable the control rope 12 to pass clear of the raised section 26 without rubbing.

The clam cleat 24, a V-shaped cleat with ridges on the interior surfaces, holds the control rope 12 at various positions. Cleat 24 is most often used to hold the rope 12 when the control handle 13 is in the fully rearward position. The second cleat 25, mounted alongside the first 24, has smooth inner surfaces which allow the control rope 12 to slip through the jaws easily. One purpose of this cleat 25 is to permit the correct length of control rope 12 to extend below the hull 1 during the cutback maneuvers. This aligns the sled 1 in the proper angle with respect to the boat wake so that the most successful performance of this maneuver is achieved. When the control rope 12 is in the fully extended position, and the sled 1 is fully out to one side of the boat, the rider pulls the control handle 13 all the way in, or toward the rear, to cause the bow 2 of the sled 1 to swing toward the stern of the boat. The rider than places the control rope 12 in the jaws of the cleat 25 and releases the handle 13. The control rope 12 runs out smoothly and the bow 2 of the sled 1 swings toward the opposite side of the boat until the knot 40 in the rope 12 seats up against the rear face of the cleat 25. This results in the correct extension of the control rope 12 to permit the bow 2 of the sled 1 to strike the boat wake at a favorable angle. This action could not be duplicated using the clam cleat 24 or any single cleat arrangement.

The control rope 12 is attached to the tow rope 16 by a loose knot 15 tied around the tow rope 16 and arranged to slide along the tow rope 16. In order to prevent the control rope 12 from sliding too far along the tow rope 16 toward the rear when the control rope 12 is extended, the tow rope 16 has a stopper knot 30 positioned to engage the loose knot 15 well forward of the rear opening 19 and prevent further rearward movement of the loose knot 15.

Flat plates 28 and 29 shown in detail in FIGS. 9 and 10, are attached to the stern of the hull 1 by hinges 32 and 33. The hinges 32 and 33 permit the orientation of the plates 28 and 29 to be adjusted. The plates 28 and 29 are locked in position by lock mechanisms 34 and 35. The plates 28 and 29 provide a lift force at the stern so that the sled 1 can be adapted to accommodate riders of various weights. The plates 28 and 29 are asymetrical in shape as shown in FIG. 9 and are attached distant from the centerline of the sled 1 to insure that drag assists in turning the sled.

The exterior surface of the hull 1 is made of supple material to reduce the possibility of injury to the rider. The interior of the hull 1 has a rigid backbone or stringer to provide hull 1 strength. The stringer is configured to support all fixtures which are rigidly connected to the hull 1.

While the invention has been described with reference to a specific embodiment, the exact nature and scope of the invention is defined in the following claims.

What is claimed is:

1. A towed water sled vehicle comprising, a body, a first rope attachment mounted on the body near a stern thereof, a second rope attachment mounted on the body forward of the first attachment, a first rope connected to the first attachment and a second rope connected to the second attachment, joint means for joining the ropes remote from the attachments and means for towing the vehicle from the joint means, and holding means connected to the vehicle for holding the first rope close to the vehicle thereby preventing tipping of the vehicle, the holding means comprising a laterally arced groove formed in the body and positioned between the first and second rope attachments, a slide mounted in said arced groove and having a portion extending from the body with an opening of a diameter slightly larger than the first rope, the first rope passing through the opening a first closure means permanently connected to one end of the arced groove for preventing movement of the slide past the end of the arced groove, and a second closure means removably connected to a remote end of the groove for preventing movement of the slide past the remote end of the groove.

2. The apparatus of claim 1 wherein, the groove extends across substantially the entire lateral dimension of the bottom of the body.

3. The apparatus of claim 1 wherein the laterally arced groove is formed along a path every point of which is equidistant from the first rope attachment.

4. The apparatus of claim 1 wherein the slide is formed of a plastic material less rigid than the material from which the arced groove is formed.

5. A towed water sled vehicle comprising, a body, a first rope attachment mounted on the body near a stern thereof, a second rope attachment mounted on the body forward of the first attachment, a first rope having a radial projection and connected to the first attachment and a second rope connected to the second attachment, joint means for joining the ropes remote from the attachments wherein the second rope joins the first rope forward of said radial projection which limits rearward movement of the second rope along the first rope, and means for towing the vehicle from the joint means, and holding means connected to the vehicle for holding the first rope close to the vehicle thereby preventing tipping of the vehicle, the holding means comprising a laterally arced channel connected to the body and positioned between the first and second rope attachments, a slide mounted in said arced channel and having a portion extending from the body with an opening of a diameter slightly larger than the first rope, the first rope passing through the opening.

6. The towed water sled vehicle of claims 1 or 5 wherein, the body has a passenger compartment with a rope holding means and a handle holding means, the second attachment comprises an opening in the body and the second rope passes through the opening in the body, and further comprising a handle connected to one end of the second rope, and a cleat comprises the handle holding means and holds a handle connected to the second rope a distance from the opening in the body, and a V-cleat comprises the rope holding means and holds any portion of the second rope disposed therein.

7. The apparatus of claim 6 wherein the body has a dished passenger compartment with an integrally formed backrest and seat and spaced footrests on sloped-forward walls of the compartment and wherein a cleat and a V-cleat are positioned on a centerline of the body between the spaced footrests in the passenger compartment.

8. The towed water sled vehicle of claim 5, wherein the joint means comprises a loop member on an end of the second rope remote from the second attachment and slidably engaging the first rope forward of the radial projection, said radial projection being positioned between the first attachment and the loop member for limiting rearward movement of the loop member along the first rope.

9. The towed water sled vehicle of claims 1 or 5 further comprising, adjustable connecting means connected to a stern of the body for supporting tabs in selected orientations with respect to the body, and tabs connected to the adjustable connecting means for controlling the trim of the towed water vehicle.

10. The apparatus of claim 9 wherein the tabs are positioned remote from a centerline of the hull.

11. The apparatus of claim 9 wherein the tabs have longitudinal dimensions which increase toward centerline of the hull.

12. A towed water sled vehicle comprising, a body having a passenger compartment with a rope holding means and handle holding means, a first rope attachment mounted on the body near the stern thereof, a second rope attachment mounted on the body forward of the first attachment, a first rope connected to the first attachment and a second rope connected to the second attachment, and joint means for joining the ropes remote from the attachments and means for towing the vehicle from the joint means, holding means connected to the vehicle for holding the first rope close to the vehicle thereby preventing tipping of the vehicle, the holding means comprising a laterally arced groove formed in the body and positioned between the first and second rope attachments, a slide mounted in said arced groove and having a portion extending from the body with an opening of a diameter slightly larger than the first rope, the first rope passing through the opening, wherein the body comprises relatively rigid internal stringers and relatively supple external coatings formed on the stringers, wherein said supple external coating has therein formed footpads, a seat, and handrail receiving means, the stringers configured to receive the first and second rope attachments.

13. The towed water sled vehicle of claim 12 wherein the second attachment comprises an opening in the body and the second rope passes through the opening in the body, and further comprising a handle connected to one end of the second rope, and a cleat comprises the handle holding means and holds a handle connected to the second rope a distance from the opening in the body, and a V-cleat comprises the rope holding means and holds any portion of the second rope disposed therein.

14. The towed water sled vehicle of claims 1 or 12 wherein the first rope has a radial projection, the second rope joins the first rope forward of said radial projection, and wherein the joint means comprises a loop member on an end of the second rope remote from the second attachment and slidably engaging the first rope forward of the radial projection, said radial projection being positioned between the first attachment and the loop member for limiting rearward movement of the loop member along the first rope.

15. The towed water sled vehicle of claim 12 further comprising adjustable connecting means connected to a stern of the body for supporting tabs in selected orientations with respect to the body, and tabs connected to the adjustable connecting means for controlling the trim of the towed water vehicle.

16. A towed water sled vehicle comprising a body, a first rope attachment mounted on the body near a stern thereof, a second rope attachment mounted on the body forward of the first attachment, a first rope connected to the first attachment and a second rope connected to the second attachment, joint means for joining the ropes remote from the attachments and means for towing the vehicle from the joint means, and holding means connected to the vehicle for holding the first rope close to the vehicle thereby preventing tipping of the vehicle, the holding means comprising a laterally arced groove formed in the body and positioned between the first and second rope attachments, a slide mounted in said arced groove and having a portion extending from the body with an opening of a diameter slightly larger than the first rope, the first rope passing through the opening, a first closure means permanently connected to one end of the arced groove for preventing movement of the slide past the end of the arced groove, and a second closure means connected to the groove for selectively blocking a remote end of the groove to passage of the slide.

* * * * *